US010517361B2

(12) United States Patent
Heim

(10) Patent No.: US 10,517,361 B2
(45) Date of Patent: Dec. 31, 2019

(54) CROSS-COUNTRY INTERCHANGEABLE PLATE SYSTEM

(71) Applicant: LEKISPORT AG, Baar (CH)

(72) Inventor: Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 0 days.

(21) Appl. No.: 15/569,449

(22) PCT Filed: Apr. 8, 2016

(86) PCT No.: PCT/EP2016/057816
§ 371 (c)(1),
(2) Date: Oct. 26, 2017

(87) PCT Pub. No.: WO2016/173827
PCT Pub. Date: Nov. 3, 2016

(65) Prior Publication Data

US 2018/0295954 A1 Oct. 18, 2018

(30) Foreign Application Priority Data

Apr. 27, 2015 (CH) ..... 00578/15
Nov. 27, 2015 (CH) ..... 01733/15

(51) Int. Cl.
*A45B 9/04* (2006.01)
*A63C 11/24* (2006.01)
*A63C 11/22* (2006.01)

(52) U.S. Cl.
CPC ..... *A45B 9/04* (2013.01); *A63C 11/227* (2013.01); *A63C 11/24* (2013.01)

(58) Field of Classification Search
CPC ..... A45B 9/04; A63C 11/22; A63C 11/227; A63C 11/228; A63C 11/24
See application file for complete search history.

(56) References Cited

U.S. PATENT DOCUMENTS 1,568,423 A 1/1926 Sifferlen
3,376,880 A 4/1968 Stark
(Continued)

FOREIGN PATENT DOCUMENTS

DE 452 583 C 11/1927
DE 20 2011 002320 U1 6/2011
(Continued)

OTHER PUBLICATIONS

International Preliminary Report on Patentability dated Nov. 9, 2017 in counterpart international application No. PCT/EP2016/057816.
(Continued)

*Primary Examiner* — Frank B Vanaman
(74) *Attorney, Agent, or Firm* — Sughrue Mion, PLLC

(57) ABSTRACT

Attachment for a pole, in particular for a trekking pole, cross-country ski pole, Nordic-walking pole, or Alpine ski pole, comprising a substantially cylindrical sleeve (3) which can be fastened to the bottom free end (25) of a pole shaft (1), comprising a blind hole (22) open towards the top to accommodate the bottom free end of the pole bar, and an interchangeable element (2), which can be fastened to the sleeve in a detachable form-fitting and force-fitting manner. The sleeve comprises a head region (4) and an adjoining body region (5) extending downwards, and an outer thread (6) on at least one axial section of the body region. The interchangeable element comprises a tip or a rolling surface on the bottom end (21) thereof, wherein the interchangeable element has an axial blind hole (15) open towards the top for accommodating the sleeve.

25 Claims, 8 Drawing Sheets

(56) References Cited

U.S. PATENT DOCUMENTS

| | | | | |
|---|---|---|---|---|
| 4,676,525 | A * | 6/1987 | Sorlien | A63C 11/24 280/824 |
| 6,203,064 | B1 * | 3/2001 | Zaltron | A63C 11/24 280/824 |
| 9,226,553 | B2 * | 1/2016 | Husar | A44C 17/001 |
| 2005/0205121 | A1 * | 9/2005 | Lindgren | A45B 9/04 135/78 |
| 2011/0194275 | A1 | 8/2011 | Wu | |
| 2013/0068268 | A1 * | 3/2013 | Heim | A45B 9/04 135/78 |
| 2013/0328297 | A1 * | 12/2013 | Lenhart | A63C 11/24 280/824 |

FOREIGN PATENT DOCUMENTS

| | | | | |
|---|---|---|---|---|
| EP | 0 035 200 | A1 | 9/1981 | |
| EP | 0 906 776 | A1 | 4/1999 | |
| EP | 1 025 883 | B1 | 8/2000 | |
| GB | 05109 | | 9/1913 | |
| GB | 142 291 | A | 5/1920 | |
| WO | WO 2008/037098 | * | 4/2008 | A45B 9/04 |

OTHER PUBLICATIONS

International Search Report for PCT/EP2016/057816 dated Jul. 4, 2016.

* cited by examiner

CROSS-COUNTRY INTERCHANGEABLE PLATE SYSTEM

CROSS REFERENCE TO RELATED APPLICATIONS

This application is a National Stage of International Application No. PCT/EP2016/057816 filed Apr. 8, 2016, claiming priority based on Swiss Patent Application Nos. 00578/15 filed Apr. 27, 2015 and 01733/15 filed Nov. 27, 2015, the contents of all of which are incorporated herein by reference in their entirety.

TECHNICAL FIELD

The present invention relates to an interchangeable plate system for cross-country ski poles, hiking poles, Nordic walking poles, alpine ski poles, etc. With this system, various tip attachments, i.e. not only plates, but also other end attachments for poles, can be fastened to the pole tube in a mechanically stable and easily exchangeable manner.

PRIOR ART

Trekking poles, cross-country ski poles, Nordic walking poles, or alpine ski poles have a handle at their upper free end and a tip or a rolling surface, generally in the form of a rubber buffer, at their lower free end. There are also systems, in particular in the sphere of Nordic walking, in which a shift can be made between a tip and a rolling surface in a simple manner. The tip elements here can additionally also have a region extended in the manner of a plate in order, for example, to prevent sinking too deeply into a soft underlying surface, such as, for example, snow. Such tip elements have to be fastened as readily as possible to the lower free end so that they are not detached during use. Typically, the lower free end is a conical free end, i.e. the pole diameter tapers toward the lower free end. Accordingly, this region, although very heavily loaded, is not particularly stable and wearproof because of the small diameter. The tip element is therefore generally designed as a separate body which, from the top, has a blind hole into which the free end of the pole tube is pressed in a self-locking manner and/or is adhesively bonded.

The advantage of such fastenings is the generally good connection between tip element and pole tube, but it is disadvantageous that it is not readily possible to exchange tip elements, whether because they have to be repaired or because a fundamentally different tip element is to be inserted, for example because of changed user requirements.

EP 1 025 883 B1 discloses an interchangeable plate system, in which two extensions which are axially spaced apart from each other are arranged at the lower tube end and between which a radial tongue of the plate attachment can snap. EP 0 906 776 A1 discloses a pole tip on which various plates can be fixed at the lower pole end by means of a quarter turn fastener. EP 0 035 200 discloses a ski pole with a snow plate which is detachably fastenable thereto. The plate attachment here has a latching lever with a hook which, upon installation from below on the pole, is caught behind a tooth, which is provided with an inclination, at the end of the pole tube. When the lever is pressed down, the hook is removed again from the tooth, as a result of which the plate is released.

SUMMARY OF THE INVENTION

It is accordingly, inter alia, the object of the present invention to provide an improved tip element in the form of an attachment with an interchangeable element for the abovementioned uses, i.e. in particular for a trekking pole, cross-country ski pole, Nordic walking pole, or alpine ski pole. In particular, the interchangeable element here is intended to be fastenable detachably to a free lower end of a pole tube.

This object is achieved by the features of claim 1.

The attachment according to the invention for a pole, in particular for a trekking pole, cross-country ski pole, Nordic walking pole, or alpine ski pole, has a substantially cylindrical sleeve which is fastenable to the lower free end of a pole tube and has an upwardly open blind hole, i.e. a downwardly closed recess, for receiving the lower free end of the pole tube. An interchangeable element is fastenable detachably to the sleeve to the sleeve in a form-fitting and force-fitting manner. The sleeve therefore serves to a certain extent as an adapter between pole tube and interchangeable element.

The sleeve has a head region and a body region downwardly, i.e. directed toward the pole tip, adjoining the head region, wherein at least one axial portion of the body region of the sleeve has an external thread. The interchangeable element has a tip or a rolling surface at its lower end. As an alternative thereto, a tip is embedded in the lower end of the interchangeable element. In addition, the interchangeable element has an axial blind hole which is open upward, i.e. is directed toward the pole handle, for receiving the sleeve. The interchangeable element has an internal thread in its blind hole, or in at least one axial portion of the inner wall of the blind hole, said internal thread being suitable for engaging in the external thread arranged on the sleeve, for the purpose of fastening the interchangeable element to the sleeve.

A particularly preferred embodiment of the attachment has an interchangeable element which has anti-twist protection relative to the sleeve. Said anti-twist protection prevents rotation of the interchangeable element about the longitudinal axis of the pole tube in the circumferential direction when the interchangeable element is mounted on the sleeve. For this purpose, the interchangeable element preferably has at least one latching lug which extends in the axial direction and is suitable for engaging in a corresponding recess arranged on the sleeve. Said recess is preferably arranged on the head region of the sleeve, preferably on the lower edge of the head region. In a particularly preferred embodiment, the interchangeable element has only one single latching lug extending in the axial direction, but it is also possible to arrange a plurality of latching lugs.

The interchangeable element advantageously has a plate region, preferably an asymmetrical plate region, wherein the plate region preferably extends substantially in a plane perpendicular to a pole longitudinal axis, and preferably in only one direction or onto only one side of the interchangeable element, preferably in a direction counter to the moving direction.

If the interchangeable element has a single latching lug, the latter is preferably arranged on that side of the interchangeable element which is directed counter to a moving direction, i.e. on that side on which the plate region has its largest diameter—as measured in a direction opposed to the moving direction. Said asymmetric arrangement facilitates the deformation of the plate region and also the latching and unlatching of the latching lug.

In order to detach the interchangeable element from the sleeve, the latching lug first of all has to be removed from the recess of the sleeve. This is preferably achieved by means of deformation of the plate region, in particular preferably by means of pressing the plate region downward in the axial direction, i.e. toward the pole tip, preferably by exerting pressure on the plate surface, on the periphery thereof. Until the latching lug has moved out of the region of the recess, normally with the exerted pressure being maintained, the interchangeable element is subsequently unscrewed from the sleeve and therefore removed, for example for the purpose of interchanging with another interchangeable element.

According to a further preferred embodiment, in order to facilitate this process, in the state latched in the recess, the latching lug for this purpose can protrude over the surface contour of the sleeve at least in the upper region, and therefore the latching lug can be lifted out of the recess, for example with a tool or else with the finger.

According to a further preferred embodiment, the recess can leave free a recess for engagement with a tool axially above the free end of the latching lug (or else laterally) in the latched-in state. For example, the recess can be simply configured to be somewhat longer upward than the latching lug.

According to a further preferred embodiment, in the interchangeable element, an element facilitating the movability of the latching lug when the pole plate is pressed down can be provided, preferably in the form of a slot in the wall of the interchangeable element.

Furthermore preferably, the latching lug can be integrally formed over a movable region in the form of a rocker on the interchangeable element, and a pressing region can preferably be arranged here in a lower region facing the plate.

It is likewise possible for the interchangeable element to have a partially movable region with the latching lug, said region forming the upper region of the interchangeable element and being designed to be displaceable in the radial direction relative to the lower region of the interchangeable element such that the latching lug can be pushed out of the recess by manipulation of a pressing region opposite the latching lug.

These depicted possibilities for facilitating the removal of the latching lug can be used either individually or else in combination.

According to a further preferred embodiment, it is also possible, by means of suitable dimensioning and configuration of sleeve and interchangeable element, to provide a construction in which the interchangeable element can be interchanged without the assistance of tools, but, nevertheless, the interchangeable element is not detached during use as intended. This is made possible by an upper edge of the interchangeable element, which upper edge faces a head region of the sleeve (and which, when the interchangeable element is fastened, comes into contact with the lower edge of the head region of the sleeve) having, in the circumferential direction on one side or preferably on both sides of the latching lug, a depression extending in the axial direction to the pole plate. This has the effect that the axial height H and therefore the free length of the latching lug which is extended for the deformation or bending thereof for removal from the recess. Said longer lever and in particular the fact that the upper edge of the interchangeable element does not run directly adjacent in the circumferential direction to the recess in the head region of the sleeve, leads to the cuff of the interchangeable element being more elastic in the region and in the direction of movement of the latching lug and, as a result, the latching lug being able to be sufficiently lifted out of the recess in the radial direction without use of a tool. In this case, the axial height H is preferably at least 1.5 times longer, preferably 1.75 times longer, than the height h of the latching lug without depressions (i.e. as considered for the situation where the upper edge simply runs around the periphery or optionally in a slightly inclined manner around the periphery). In order to further facilitate the detaching of the form-fitting connection of the latching lug in the recess, it is preferably possible to design one or both of the lateral flanks of the latching recess in the circumferential direction to be beveled.

The plate region preferably has a reinforcing rib which advantageously extends from the latching lug (for example directly below the latter or even on the outside of the latching lug) to a radial tip of the plate region, or else at least partially onto and beyond the plate region. The rib therefore forms a coupling between latching lug and plate region. The radial tip is preferably arranged at the point at which the plate region has its largest diameter—as measured in a direction opposed to the moving direction. The reinforcing rib, or else another region of the plate region, can have one or more recesses, incisions or cutouts, which leads to the material saving and therefore to the reduction in weight of the interchangeable element. Said rib leads thereto or reinforces the fact that, when pressure is exerted downward on the plate region, the latching lug is also effectively displaced radially outward and out of the recess in the sleeve. This takes place since, to a certain extent, the tilting of the plate region is coupled directly or indirectly to the latching lug by means of the rib, which has the effect that, when pressure is exerted downward on the plate region, an outward pull is exerted on the latching lug or on the interchangeable element directly therebelow via the rib, the latching lug is raised out of the recess and therefore the rotatability of interchangeable element with respect to the sleeve is therefore enabled.

For the purpose of increased grip on the base, the plate region, according to a particularly preferred embodiment, in particular in the case of an interchangeable element of the classic Nordic variant with a plate region of comparatively large diameter, has a toothing on its lower side at its lower end, said toothing preferably extending along the lower edge around a part of the circumference of the plate region, in particular a part thereof which is directed rearward, i.e. in the moving direction.

The external thread on the body region of the sleeve is preferably arranged at an axial distance from the head region, i.e. between head region and external thread the body region has an upper cylindrical portion which does not have a thread. The head region is preferably separated from the body region of the sleeve by an encircling first step. Said first step or the resultantly formed lower edge of the head region advantageously forms an upper stop for an upper edge of the interchangeable element at the upper end of the interchangeable element during the fastening thereof on the sleeve.

An upper edge of the sleeve at the upper end of the sleeve preferably runs in a plane which is arranged at an inclination to a plane running perpendicularly to the pole longitudinal axis. This has the effect that the sleeve has different lengths on the front and rear side of the sleeve, as measured in the longitudinal direction parallel to the pole longitudinal axis, as measured from the upper edge of the sleeve as far as a lower edge of the sleeve at a lower end of the sleeve.

In a preferred embodiment, the head region of the sleeve is of conical design, wherein the diameter of the head region widens downward toward the body region. The abovementioned lower edge of the head region of the sleeve preferably has the same diameter as the upper edge of the interchangeable element at the upper end of the interchangeable element.

Preferably, either sleeve or interchangeable element, or, particularly preferably, both the sleeve and the interchangeable element are composed at least in regions of a plastics material, preferably a thermoplastic material. Particularly preferably, the plastic is a thermoplastic polyamide, preferably an aliphatic polyamide, such as polyamide 6, polyamide 12, polyamide 66, polyamide 126 or polyamide 612. The material is preferably selected in such a manner that, at customary use temperatures, it becomes neither too soft nor too brittle, at low temperatures, and that it has sufficient impact toughness while, however, continuing to have sufficient flexibility for the movability in particular of the latching lug. The modulus of bending should accordingly typically be within the range of 2.5-3.5 at 23° C., preferably within the range of 2.75-3 MPa, preferably within the range of 2.5-4, particularly preferably within the range of 3 -3.75 MPa at −40° C. Sleeve and interchangeable element, because of their separate design, can also be manufactured from different materials in order to configure the properties thereof differently, for example in respect of function, installation or wear resistance.

The present invention furthermore relates to a pole, in particular trekking pole, cross-country ski pole, Nordic walking pole, or alpine ski pole, having a pole tube with a pole handle at an upper free end, wherein the lower free end of the pole tube, i.e. the end directed toward the pole tip or toward the base during use, has an attachment according to one of the above-described embodiments. The sleeve is preferably mounted fixedly at the lower free end of the pole tube, preferably by means of adhesive bonding or pressing.

Further exemplary embodiments are described in the dependent claims.

BRIEF DESCRIPTION OF THE DRAWINGS

Preferred embodiments of the invention are described below with reference to the drawings which serve merely for explanation and should not be interpreted as limiting. In the drawings.

DESCRIPTION OF PREFERRED EMBODIMENTS

Figure 1:
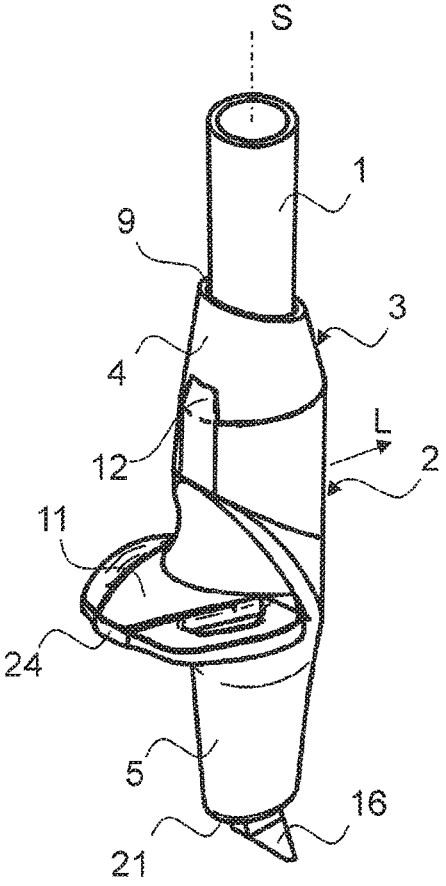
FIG. 1 shows a schematic illustration of the attachment mounted on the lower end of a pole tube with an interchangeable element according to a first preferred exemplary embodiment of the invention fastened thereto in the form of a skating pole plate, in a perspective view from the rear on the right.
Figure 2:
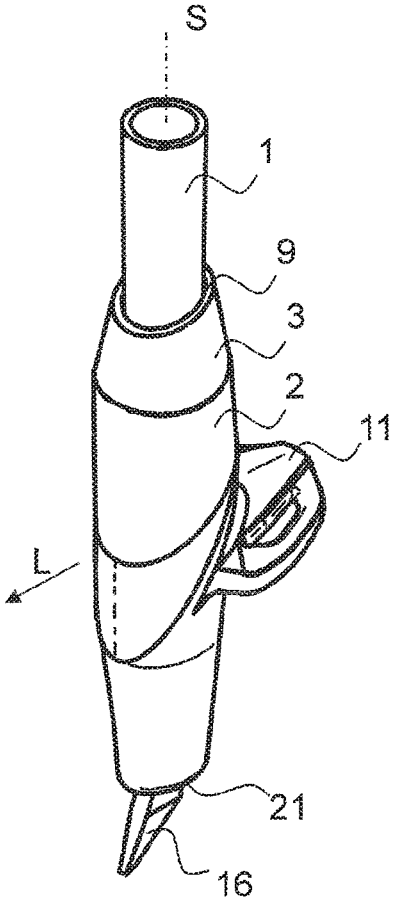
FIG. 2 shows a schematic illustration of the attachment from FIG. 1 in a perspective view from the front on the left.

FIGS. 1 and 2 illustrate a respective lower portion of a pole tube 1, with an attachment mounted thereon according to a first exemplary embodiment. In these two illustrations, an interchangeable element 2 is in each case fastened to a sleeve 3. The sleeve 3 is fastened fixedly here to the lower free end 25 of the pole tube 1 by means of an integrally bonded, force-fitting or form-fitting connection, for example by means of adhesive bonding and/or pressing on. The interchangeable element 2 here axially downwardly adjoins the lower edge 13 (cf. FIG. 3) of the head region of the sleeve 3. The interchangeable element 2 has an upper region which has a latching lug 12 protruding axially upward from the upper edge 20 of the interchangeable element. The central region of the interchangeable element 2 has an asymmetric plate region 11 which extends here in the radial direction to only one side of the interchangeable element 2, in a plane E1 substantially perpendicularly to the pole longitudinal axis S. The lower region of the interchangeable element 2 has a tip 16 which is embedded in the lower end 21 thereof. The tip 16 which is illustrated is angled in a direction (moving direction) with respect to that side of the interchangeable element 2 which lies opposite that side in which the plate region 11 extends.

Figure 3:
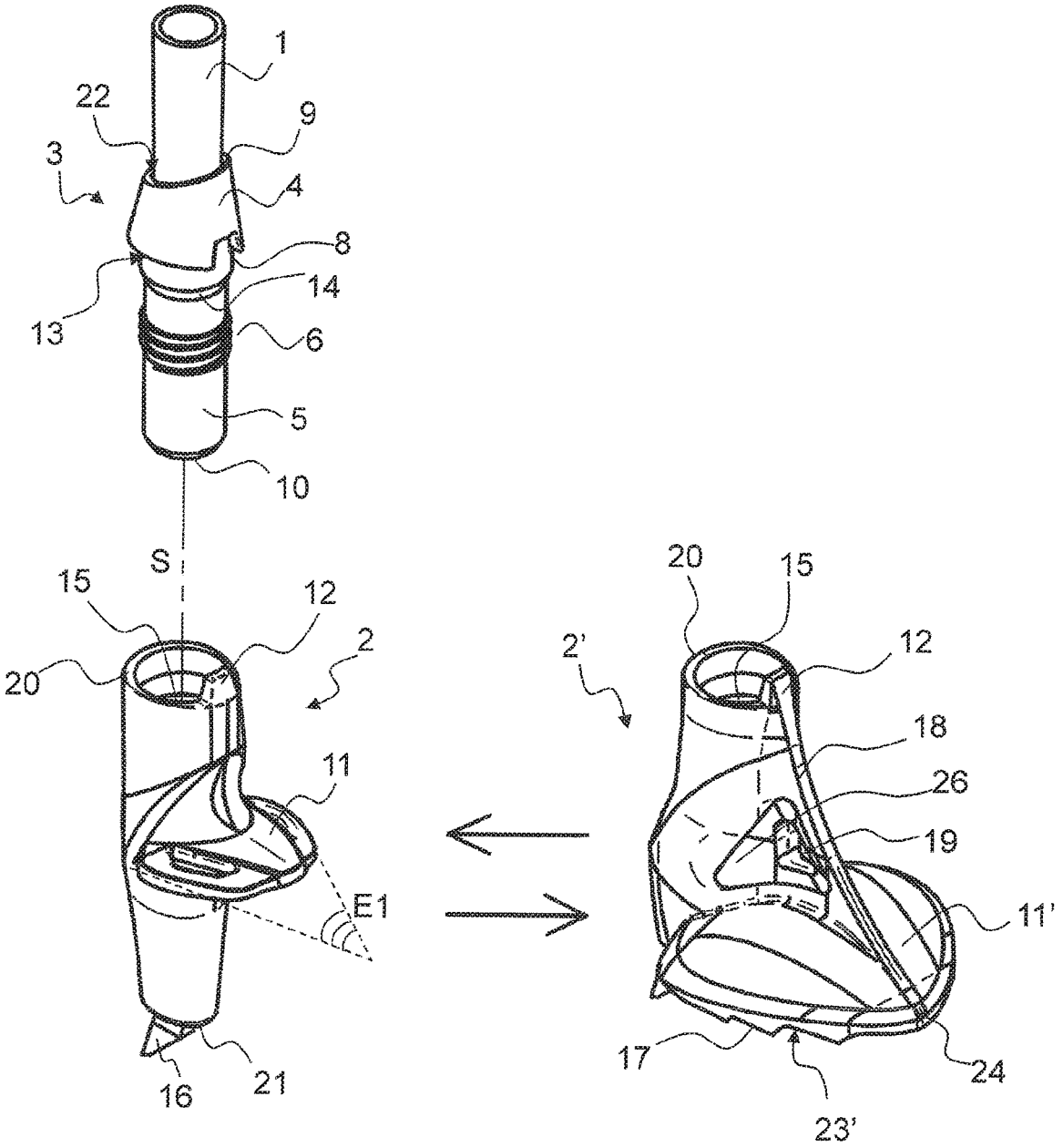
FIG. 3 shows an illustration of the attachment of the lower end of the pole tube from FIG. 1 from the rear on the left with the sleeve mounted thereon, wherein the interchangeable element according to FIGS. 1-2 is illustrated detached from the sleeve, and wherein the exchangeability of the interchangeable element according to the first preferred exemplary embodiment of FIGS. 1-2 is illustrated by an interchangeable element according to a second preferred exemplary embodiment in the form of a Nordic pole plate.

The sleeve 3 mounted at the lower free end of a pole tube 1 is illustrated at the top in the illustration of FIG. 3. The attachment according to the invention is accordingly of two-part design, namely consisting of sleeve 3 and interchangeable element 2 or 2'. The pole tube 1 is introduced at its lower free end 25 into the sleeve 3 and fastened therein. The sleeve 3 has a head region 4 and a body region 5 which downwardly adjoins the head region 4 in the axial direction S. The head region 4 has a lower edge 13 which is formed by an encircling step 7 (cf. FIG. 5) at which the head region 4 merges into the body region 5 or which forms the boundary between the head region 4 and the body region 5. Provided at said lower edge 13 and toward the pole handle (not illustrated) is a recess 8 or a notch in the head region 4 which serves for receiving and latching the latching lug 12 which extends axially from the upper edge 20 of the interchangeable element 2. During the fastening of the interchangeable element 2 to the sleeve 3, said latching device also serves, in addition to the fastening, for anti-twist protection by the interchangeable element 2 being fastened in a form-fitting manner so as to be secure against rotation in the circumferential direction U in relation to the sleeve 3 or in relation to the pole tube 1. This is in particular of importance in the case of asymmetrical pole plates, like the two illustrated in FIG. 3.

In the illustrated exemplary embodiment of FIG. 3, the sleeve 3 also has, in a central region of the body region 5, a second encircling step 14 axially below the first encircling step 7. Below said second encircling step 14, the body region 5 has an external thread 6 which extends downward over an axial portion of the body region 5. In this preferred embodiment, the upper edge 9 of the sleeve 3 or of the head region 4 of the sleeve 3 has an inclined surface. The latter lies in a plane E2 (also see FIG. 7) which is angled with respect to the plane E1 (see, for example, FIG. 6) which extends perpendicularly to the pole longitudinal axis S and in which the plate region 11, 11' substantially extends.

Directly below the sleeve 3, an interchangeable element 2 according to a first preferred exemplary embodiment, as already shown in FIGS. 1 and 2, is illustrated on the left in FIG. 3. On the right next thereto, an interchangeable element 2' according to a second exemplary embodiment is illustrated. The need-dependent exchangeability of the two interchangeable elements 2 and 2' is illustrated by the two arrows. The interchangeable element 2 illustrated on the left is illustrated in the form of what is referred to as a skating pole plate. This is used, for example, in the skating variant of cross-country sport, in contrast to the interchangeable element 2', which is illustrated on the right, in the form of what is referred to as a Nordic pole plate having a larger diameter which is used primarily for classic or Nordic cross-country sport.

Figure 5:
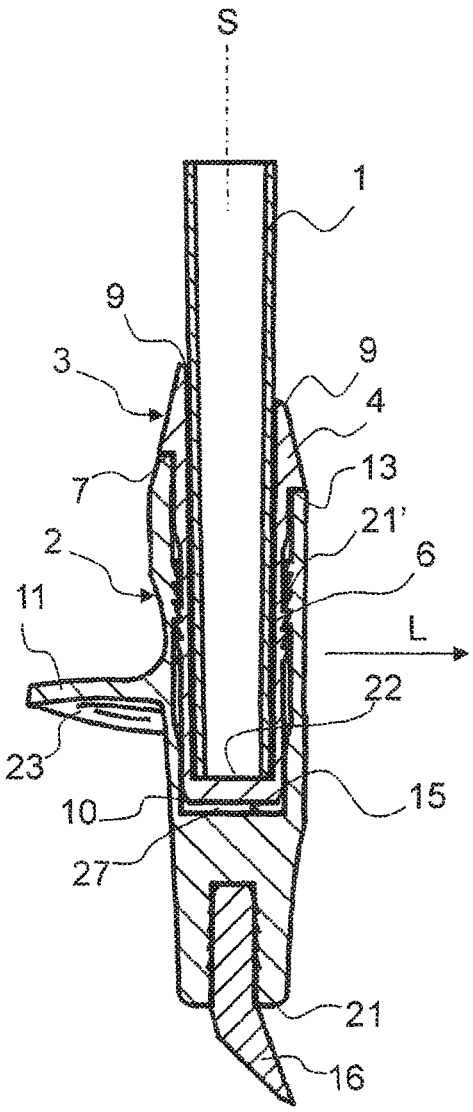
FIG. 5 shows a sectional illustration along the axial line A-A of FIG. 4.

Both variants of the interchangeable element 2, 2' have an asymmetrical plate region 11, 11' which extends substantially in a direction counter to the moving direction L from the pole tube 1 to only one side of the interchangeable element 2, 2'. The interchangeable element 2, 2' is in each case of integral design, with a hard metal or ceramic tip 16 embedded at the lower end 21 or fastened therein. The interchangeable element 2, 2' has a blind hole 15 at the free lower end 25 of the pole tube 1 for receiving the sleeve 3. In the interior of the interchangeable element 2, 2', the wall of the blind hole 15 has an internal thread 21', as illustrated in FIG. 5, approximately at the medium height of the blind hole 15. The internal thread 21' engages in the external thread 6 of the sleeve 3 when the interchangeable element 2, 2' is screwed onto the lower end of the pole. In the mounted end position, the latching lug 12 on the upper edge 20 of the interchangeable element 2, 2' engages in a substantially form-fitting manner in the mentioned corresponding recess 8 in the head region 4 of the sleeve 3. The latching lug 12 in the exemplary embodiment illustrated is formed with an upwardly tapering contour.

The interchangeable element 2' illustrated on the right has a reinforcing rib 18 or strut which extends from the latching lug 12 as far as the radial tip 24 of the plate region 11' at the point with the largest diameter d3. The reinforcing rib 18 has a recess 19 in the form of a passage opening which is arranged transversely with respect to the direction of extent of the reinforcing rib 18 and serves for saving on material and therefore on weight, and also a notch or cutout 26 surrounding the recess.

Figure 4:
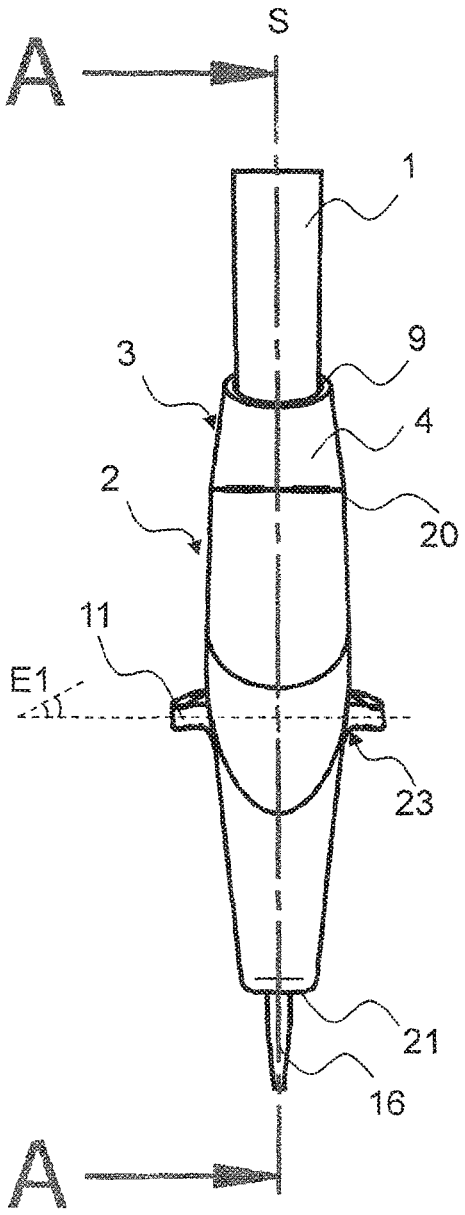
FIG. 4 shows a schematic illustration of the attachment from FIG. 1 with the interchangeable element according to the first preferred embodiment in the form of a skating pole plate, in a view from the front.

FIG. 4 illustrates a view of the attachment according to the invention with the interchangeable element 2 according to the first exemplary embodiment of the invention, i.e. with the skating plate, in a view counter to the moving direction L, i.e. as seen from the front. It can be seen here that the entire plate region 11 is formed on a side of the interchangeable element 2 which is opposed to the moving direction L, i.e. to the rear in the moving direction. At the point at which the plate region 11 is arranged, the interchangeable element 2 has its widest point or the widest diameter d3 and is designed to be tapered toward the upper edge 20 and downward toward its lower end 21. The sleeve 3 is embedded in the interchangeable element 2 in such a manner that only the head region 4 of said sleeve projects out of the interchangeable element 2, wherein the upper region of the interchangeable element 2, which region is arranged above the plate region 11, merges at the upper edge 20 of the interchangeable element 2 virtually seamlessly into the head region 4. The lower edge 13 of the head region 4 rests here on the upper edge 20 of the interchangeable element 2. As is also correspondingly illustrated in FIG. 7, in the sleeve 3 illustrated in FIG. 5 the length 11 of the sleeve 3 is also designed to be longer in the rear region, because of the design of its upper edge 9 inclined relative to the perpendicular plate profile plane E1 in the plane E2 (cf. FIG. 7), than the length 12 in the front region. The lower region of the interchangeable element 2 is designed to converge conically downward, as can be seen in FIG. 4. The plane E1 in which the plate region 11 substantially extends lies perpendicularly to the pole longitudinal axis S.

The engagement of the internal thread 21' of the interchangeable element 2 in the external thread 6 of the sleeve in a central region of the blind hole 15 of the interchangeable element 15 can be seen in the sectional illustration of FIG.

5. The pole tube 1 is completely introduced here into the blind hole 22 of the sleeve 3. When the sleeve 3 is completely introduced into the blind hole 15 of the interchangeable element 2, this sleeve 3 is spaced apart from the bottom of the blind hole 15 by a small axial intermediate space 27.

Figure 6:
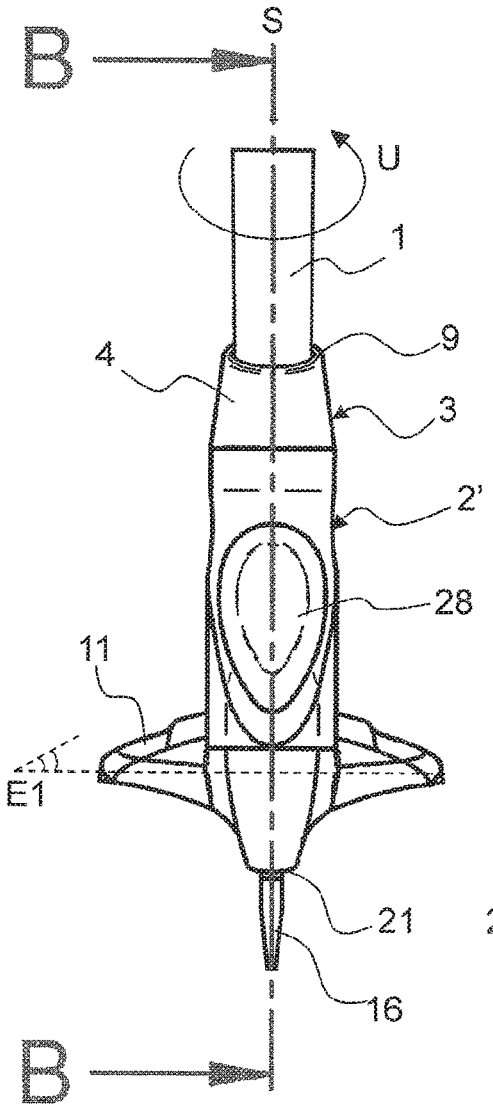
FIG. 6 shows a schematic illustration of the attachment from FIG. 1 with an interchangeable element according to the second preferred embodiment in the form of the Nordic pole plate, in a view from the front.
Figure 7:
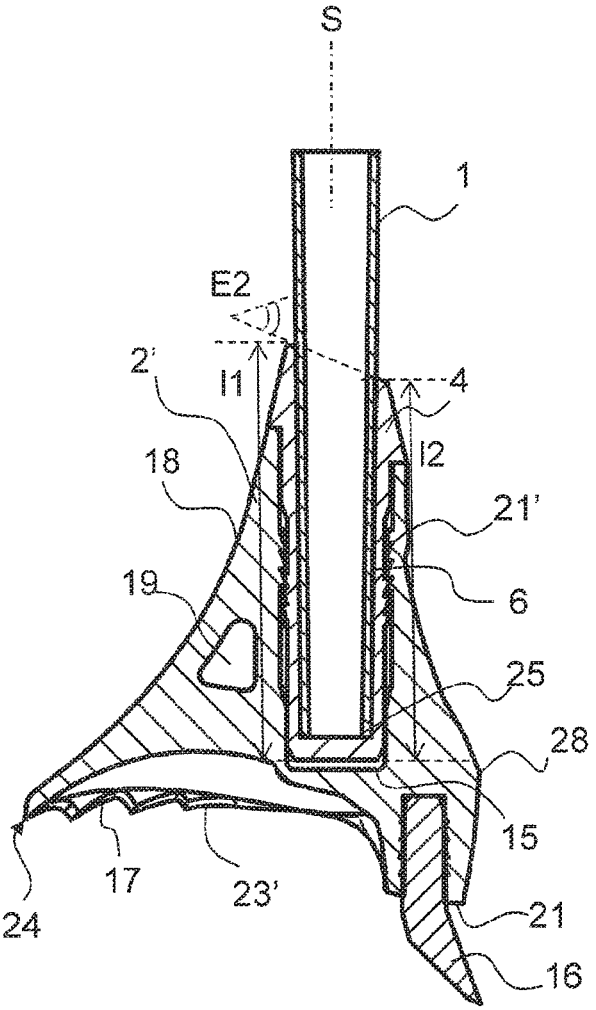
FIG. 7 shows a sectional illustration along the axial line B-B from FIG. 6.

FIG. 6 corresponds to the view of FIG. 4, apart from the fact that, in the illustrated attachment of FIG. 6, the interchangeable element 2' according to the second preferred embodiment, i.e. with the larger diameter Nordic plate region 11', is placed onto the sleeve 3. The widening 28, which is directed forward, i.e. in the moving direction L, of the diameter in the region of the interchangeable element 2, in which the plate region 11' is arranged, can be seen in FIG. 6 and in the sectional illustration of FIG. 7. The lower side 23' of the interchangeable element 2' of FIG. 7 has, in the rear region, a toothing 17 which provides the pole with increased grip on the base.

Figure 8:
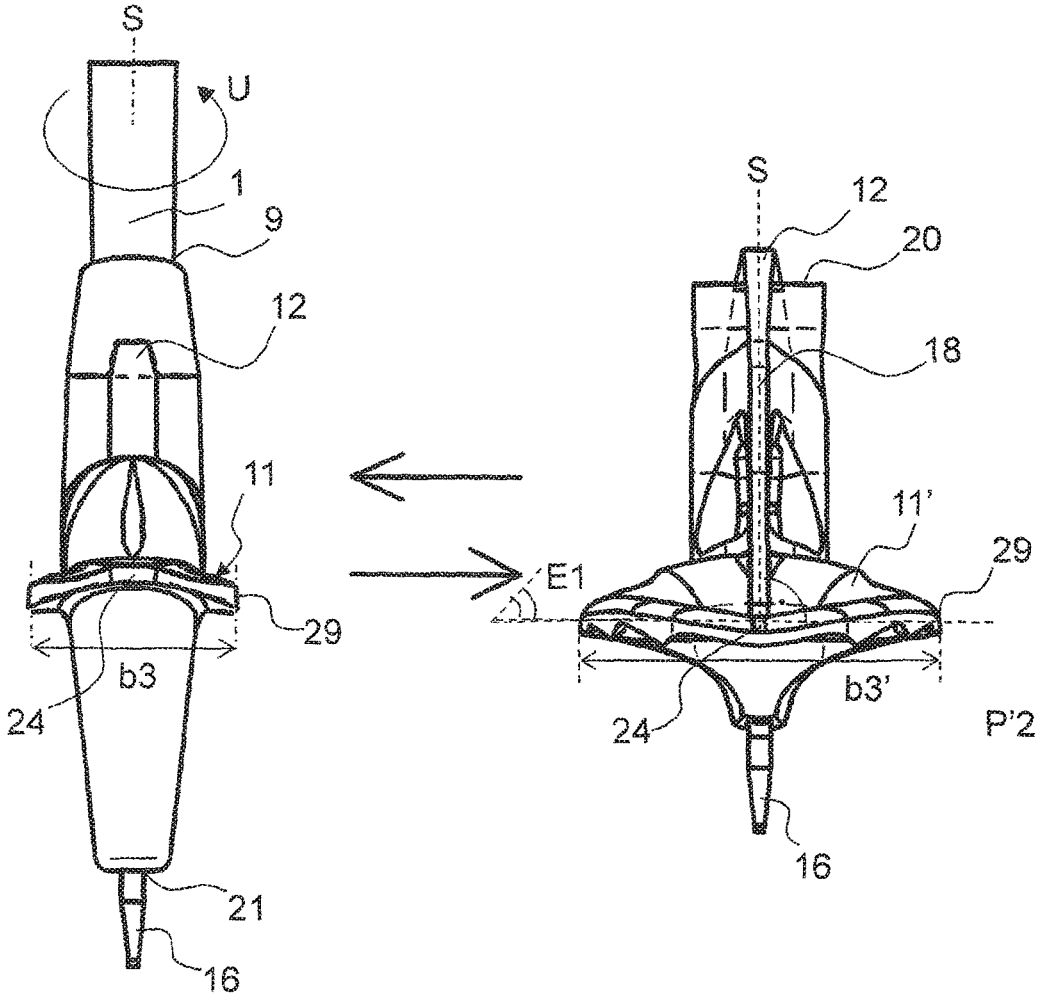
FIG. 8 shows a schematic illustration of the attachment from FIG. 1, wherein the exchangeability of the interchangeable element according to the first preferred exemplary embodiment in the form of the skating pole plate with an interchangeable element according to the second preferred exemplary embodiment in the form of the Nordic pole plate is illustrated in a schematic view from the rear, i.e. along the moving direction.
Figure 11:
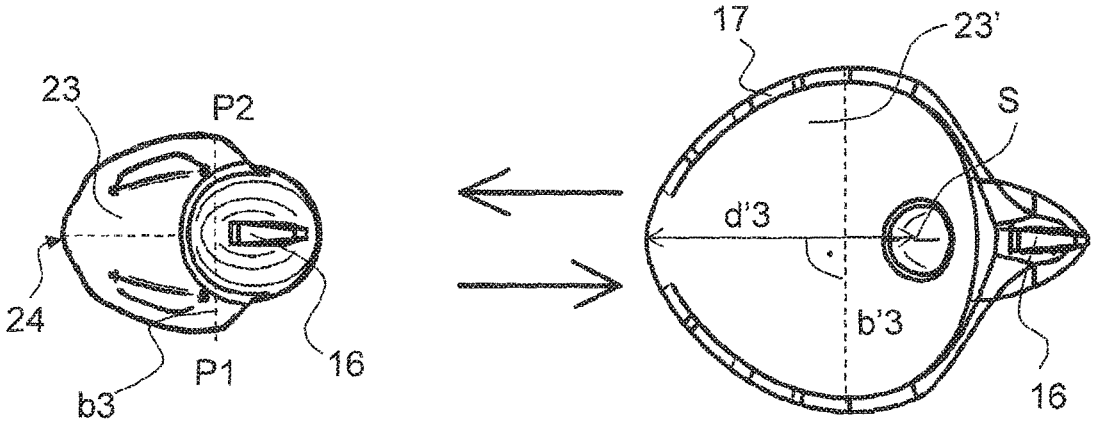
FIG. 11 shows a schematic illustration of the attachment according to FIG. 8 with the interchangeable element according to the first preferred exemplary embodiment, and also on the right next thereto, the interchangeable element according to the second preferred exemplary embodiment in a view from below along the pole longitudinal axis.

FIG. 8 again illustrates the exchangeability of the two variants of interchangeable elements 2, 2' schematically with arrows. The plane E1 in which the plate region 11, 11' substantially extends is spanned here by the radial tip 24 of the plate region 11, 11' (as also illustrated in FIG. 11) and the intersecting points of the side edge 29 of the plate region 11, 11' at the point with the largest width b3 of the plate region 11, 11'. This plane E1 runs substantially perpendicularly to the pole longitudinal axis S.

Figure 9:
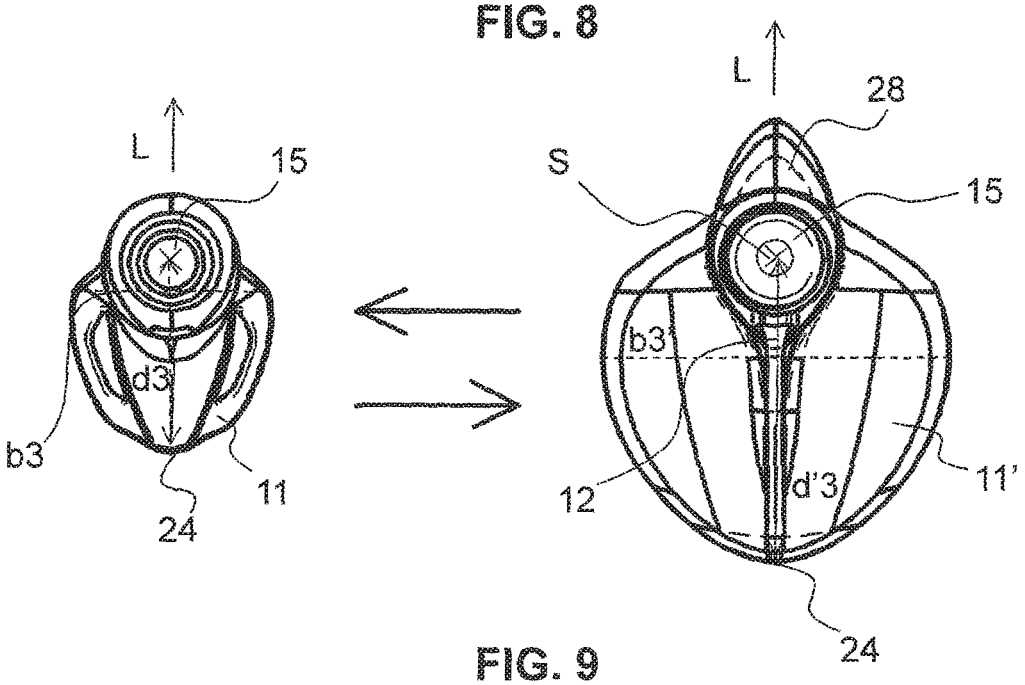
FIG. 9 shows a schematic illustration of the attachment according to FIG. 8 with the interchangeable element according to the first preferred exemplary embodiment, and also on the right next thereto, the interchangeable element according to the second preferred exemplary embodiment in a view from above along the pole longitudinal axis.

In FIG. 9, the same two variants of the interchangeable elements 2, 2' are illustrated from above, wherein the concentric arrangement of the pole tube 1, the sleeve 3 and the interchangeable element 2, 2' can be seen. It can also be seen that the latching lug 12 is aligned radially in a direction opposed to the moving direction L with the radial tip 24 of the plate region 11, 11', here along the reinforcing rib 18. If the plate region 11, 11' is pressed downward at this point with the largest diameter d3 (as measured from the pole longitudinal axis S counter to the moving direction L), the latching lug 12 snaps out of the recess 8 and the interchangeable element 2, 2' can be unscrewed from the sleeve 3. This arrangement of the latching lug 12 simplifies the mechanical deformation of the plate region 11, 11'.

Figure 10:
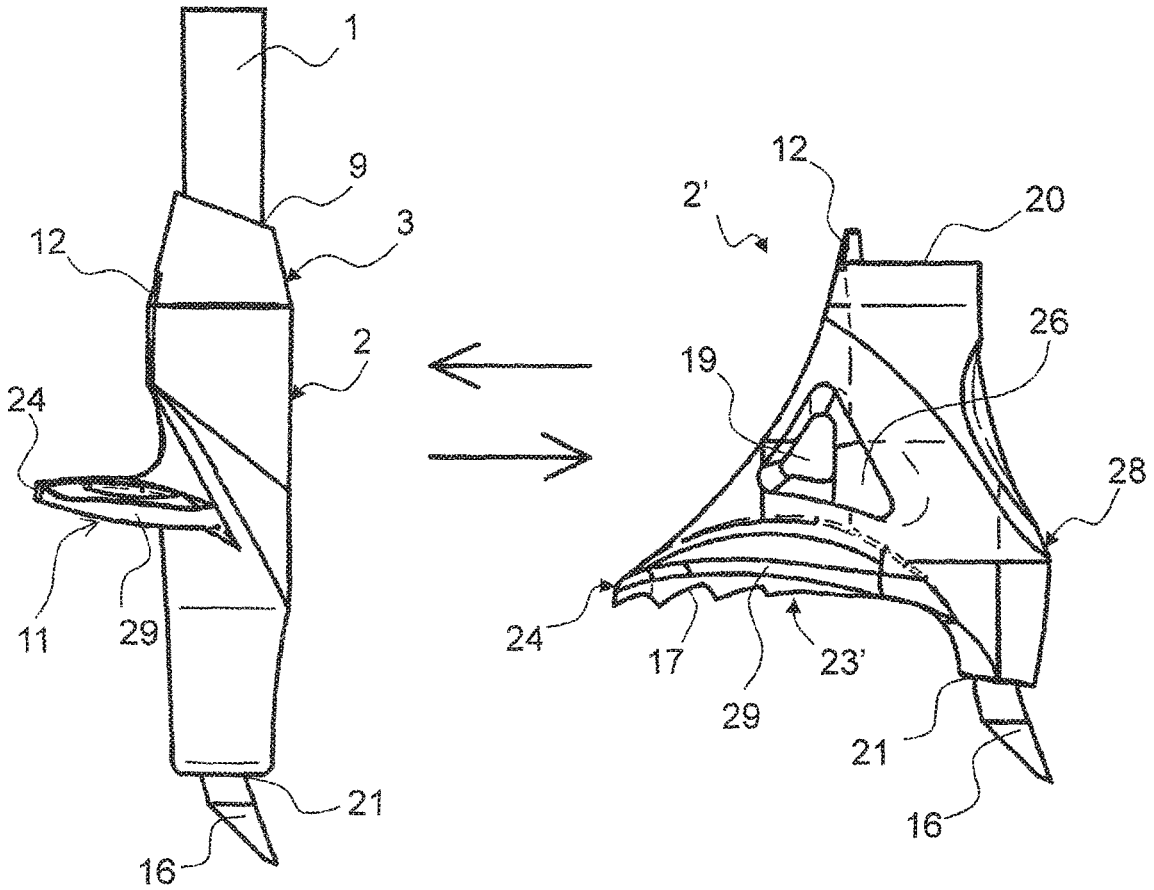
FIG. 10 shows a schematic illustration of the attachment according to FIG. 8 with the interchangeable element according to the first preferred exemplary embodiment, and also on the right next thereto, the interchangeable element according to the second preferred exemplary embodiment, in a side view from the right.

The side view of the two interchangeable elements 2, 2' in FIG. 10 shows a view of the side contours, and the relative dimensions of the two plate variants can be readily seen in the bottom view of FIG. 11. The plate region 11 or 11' has the greatest width b3 or b3' between those regions of the side edge 29 of the plate region 11 or 11' which project the furthest, wherein the width is measured at right angles to the diameter d3 which is measured in a direction opposed to the moving direction L as a distance of the radial tip 24 from the pole longitudinal axis S.

Figure 12:
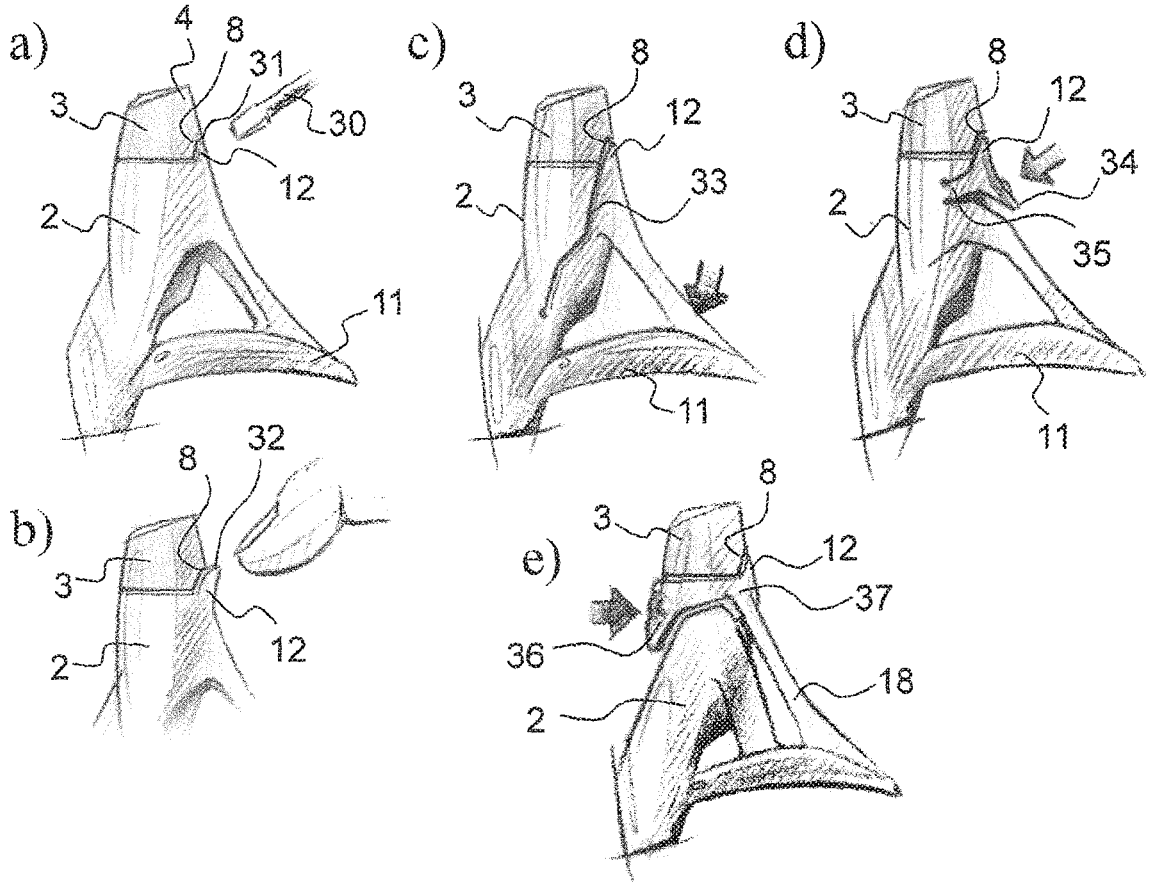
FIG. 12 shows various further embodiments of the interchangeable element, wherein a) illustrates a design with a recess which is accessible for a tool, b) illustrates a design with a protruding region of the latching lug, c) illustrates a design with a slot for better movability of the latching lug, d) illustrates a design in which the latching lug is designed in the form of a rocker, and e) illustrates a design in which an entire region of the interchangeable element with the latching lug is configured to be radially movable.

FIG. 12 illustrates various further variants of interchangeable elements, with different means which make it easier for the latching lug 12 to be able to be removed from the recess 8 in order to release the form-fitting connection in the latched-in state.

For example, FIG. 12 *a*) illustrates a variant in which the recess 8 exposes a recess 31 axially above the free upper end of the latching lug 12 in the latched-in state for engagement with a tool, for example a screwdriver 30. For the release, the screwdriver 30 can be inserted in said recess 31, the screwdriver can be tilted and then the interchangeable plate can be screwed.

FIG. 12 *b*) illustrates a variant in which, in the state latched in the recess 8, the latching lug 12 for this purpose protrudes 32 over the surface contour of the sleeve 3 at least in the upper region. The latching lug 12 can then likewise be grasped at the upper edge either with a tool or else simply with a finger and removed from the recess 8. This variant can preferably also be combined with a recess 31, as illustrated in FIG. 12*a*.

FIG. 12 *c*) illustrates a further variant in which an element facilitating the movability of the latching lug 12 when the pole plate 11 is pressed down and is here in the form of a slot 33 in the wall of the interchangeable element 2 is provided in the interchangeable element 2. If the plate is pressed down, the entire region of the interchangeable element 2 arranged on the right side of the slot 33 is displaced and therefore the form-fitting connection can be easily released. Since, when the plate is loaded, pressure is exerted in the other direction than illustrated by the arrow in FIG. 12 *c*), secure fastening during use can nevertheless be ensured.

A further possible design is illustrated in FIG. 12 *d*); the latching lug 12 here has a movable region 35 in the form of a rocker on the interchangeable element. Said rocker is integrally formed on the interchangeable element 2, wherein there is a flexible region 35 which acts to a certain extent as a pivot point. If a pressing region 34 is formed in the lower region of said rocker, the lower region facing the plate, and if pressure is exerted on said lower pressing region 34, for example by hand, as illustrated by the arrow, the rocker tilts about the flexible region 35 and the latching lug 12 is removed from the recess 8. Finally, FIG. 12 *e*) illustrates a design in which the interchangeable element 2 has a partially movable region 37 with the latching lug 12, said region forming the upper region of the interchangeable element 2 and being designed to be displaceable in the radial direction relative to the lower region of the interchangeable element 2. Said partially movable region engages in an encircling manner around the sleeve 3 in the upper region, and therefore the latching lug 12 can be pushed out of the recess 8 by manipulation of a pressing region 36 lying opposite the latching lug 12, for example using a finger. This design has the advantage that it cannot be undesirably released upon loading of the plate.

Figure 13:
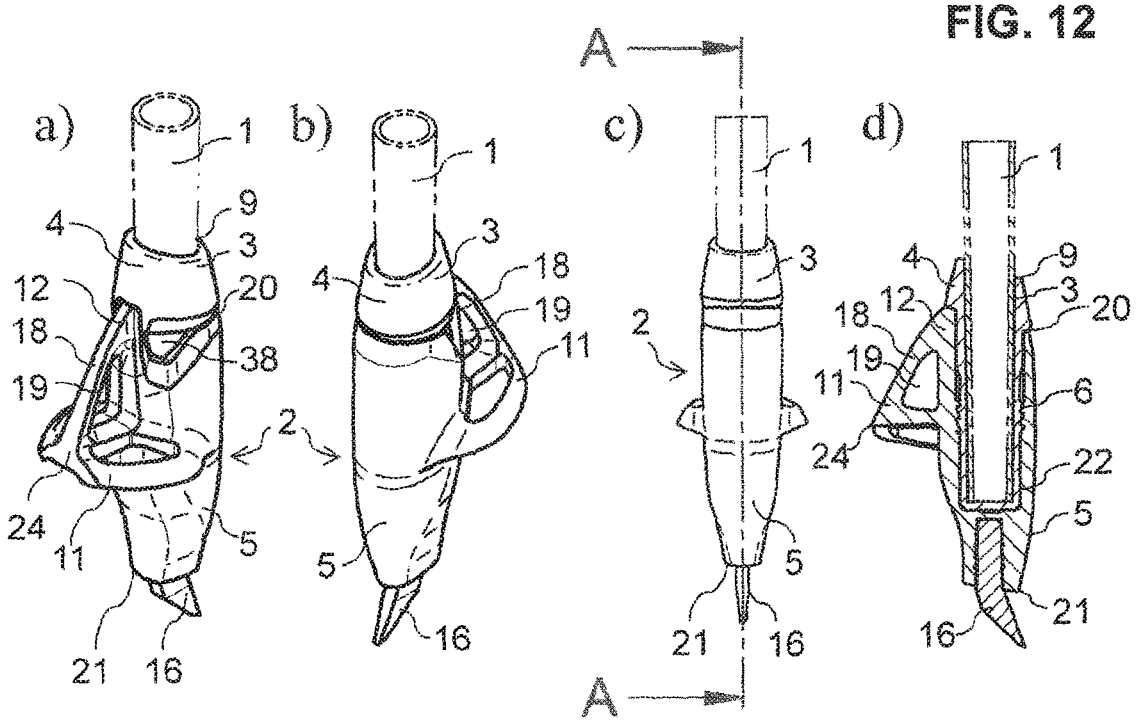
FIG. 13 shows illustrations of a further exemplary embodiment, wherein the interchangeable element is designed as a skating plate, and wherein a) provides a perspective view obliquely from the rear at the top (in each case with respect to the moving direction), b) provides a perspective view obliquely from the front at the top, c) provides a view from the front, and d) provides the section according to the line A-A in figure c)
Figure 14:
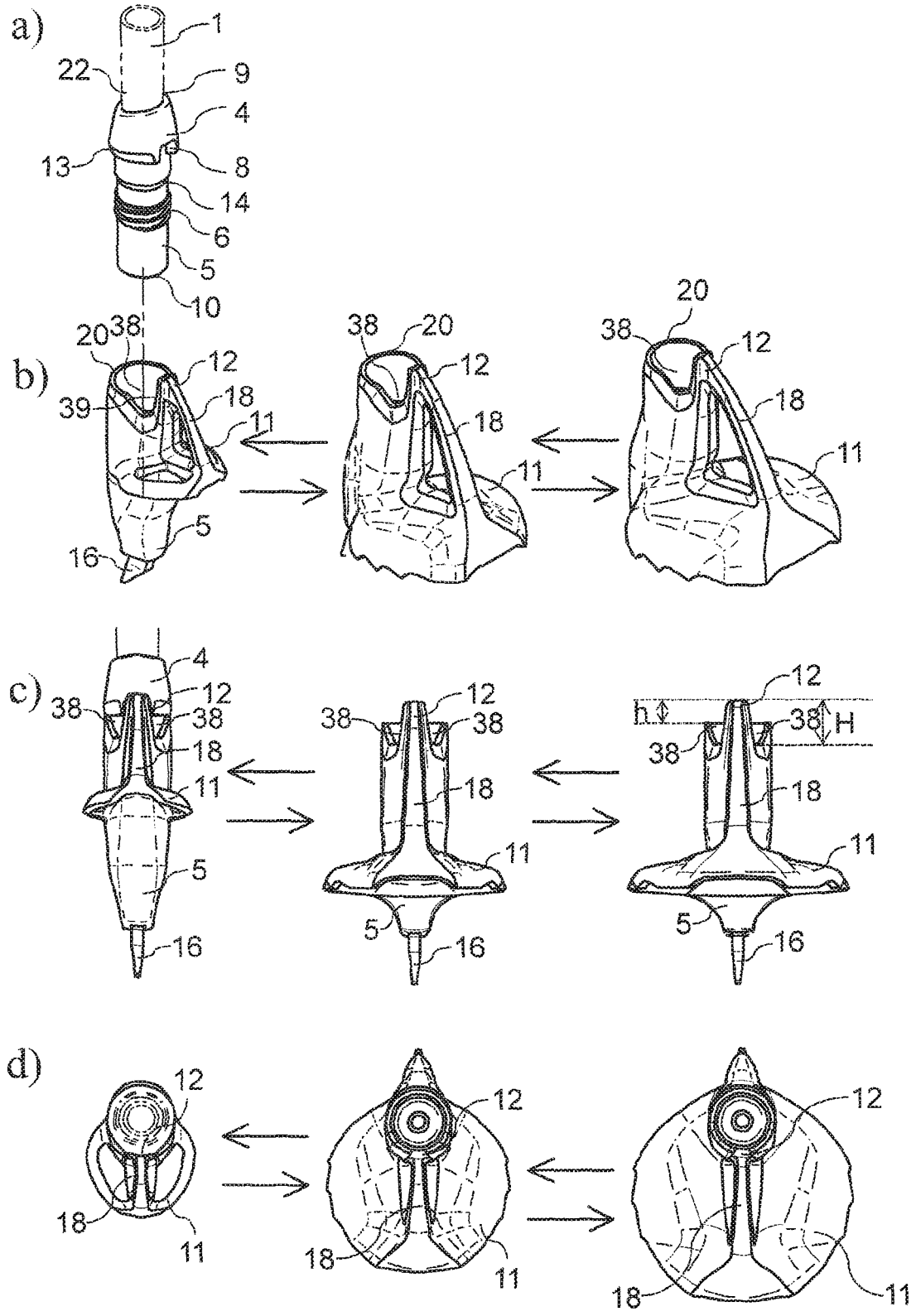
FIG. 14 shows illustrations of the exemplary embodiment according to FIG. 13 with further interchangeable elements, a Nordic plate of average size (in each case in the center) and a large Nordic plate (in each case on the right), wherein a) illustrates the pole tube with the sleeve fastened thereto without an interchangeable element, b) illustrates the various possible interchangeable elements which can be placed exchangeably onto the sleeve according to figure a) in a perspective view obliquely from the rear at the top (in each case with respect to the moving direction), c) illustrates a view from the rear, and d) illustrates a view from above.

FIGS. 13 and 14 illustrate a further exemplary embodiment of an interchangeable tip of this type. The same or analogous elements are denoted by the same reference signs as in the above-described exemplary embodiments. What substantially differentiates this exemplary embodiment from the above-described exemplary embodiments is that the upper edge 20 of the interchangeable element 2 is specially configured. While, in the case of the above-described exemplary embodiments, the upper edge runs substantially at the same height, i.e. encircles to a certain extent in a circle and runs in the axial direction at the same height as far as the latching lug 12, in this exemplary embodiment there is a respective depression 38 in said upper edge 20 on both sides of the latching lug 12. In the regions adjacent to the latching lug 12, the upper edge 20 is set back toward the plate on both sides, thus forming the two depressions 38; this leads to the latching lug 12, which without the depressions has a height h with respect to the normal height of the upper edge 20 (compare FIG. 14*c*), now having a substantially greater height H as a result of the two depressions 38 arranged laterally therefrom. Preferably, the two depressions 38 here are at least half the length in the axial direction as the height h of the latching lug without the two depressions 38; particularly preferably, the height H, taking into consideration the depressions, is approximately twice the size of the height h without the two depressions.

This means that the length of the tongue-shaped axial latching lug 12 becomes larger and therefore so does the length available for bending the latching lug 12. This can now make a design possible in which the depression 8 has a considerable length in the axial direction, within the range of 3-5 mm in the indicated example, and therefore an excellent form-fitting connection is provided by the latching lug 12 during the engagement. On the other hand, because of the cutouts 38, the latching lug 12 is sufficiently flexible for the interchangeable element to be able to be released by rotation even without a tool, simply by applying a somewhat greater starting force, and the latching lug 12 can be pushed out of the depression 8 by said force. In order to facilitate this operation, the lateral flanks 39 running radially with respect to the pole axis are designed to converge toward the pole axis. In this manner, when the rotational force is applied to the latched-in interchangeable element by the oblique flank 39, which is then in contact with the lateral boundary of the recess 8, a radially outwardly directed force component is produced which makes it possible for the latching lug not to bite nondetachably in the recess 8, but rather simply only to be released with a sufficiently increased release force.

The thereby permitted design which is exchangeable without a tool and is illustrated in FIG. 14 for different interchanging possibilities in each case is set by a corresponding choice of material (for example polyamide 66) and dimensioning (for example H of approx. 9 mm, h of approx. 4-5 mm, radical thickness of the latching lug approx. 2 mm and width in the circumferential direction of the latching lug of 3-5 mm, circumferential length of the depression 38 level with the upper edge in the region of 5 mm) in such a manner that the release force of the interchangeable element is of such a magnitude that the interchangeable element cannot be released during use, but the user can still unscrew the interchangeable element by rotation, without a tool and without excessive effort.

LIST OF REFERENCE SIGNS

1 pole tube
2 interchangeable element (skating variant)
2' interchangeable element (Nordic variant)
3 sleeve
4 head region of 3
5 body region of 3
6 external thread on 3
7 first step on 3 between 4, 5
8 recess in 4 for 12
9 encircling upper edge of 3
10 encircling lower edge of 3
11 plate region of 2 (skating plate)
11' plate region of 2' (Nordic plate)
12 latching lug on 2, 2'
13 lower edge of 4
14 second step on 3
15 blind hole in 2, 2' for 3
16 tip in/on 2, 2'
17 toothing on 23'
18 reinforcing rib on 2'
19 recess in 18
20 upper edge of 2, 2'
21 lower end of 2, 2'
21' internal thread in 15
22 blind hole in 3 for 1
23 lower side of 11
23' lower side of 11'
24 radial tip of 11, 11'
25 lower free end of 1
26 notch/cutout in 18
27 axial intermediate space in 15
28 widening on 2'
29 side edge of 11, 11'
30 screwdriver
31 exposed recess above 12 in 4
32 radially outwardly protruding region of 12
33 slot in wall of 2
34 pressing region of 12
35 flexible fastening region of 12
36 opposite pressing region
37 partially movable region of 2
38 cutout in the encircling upper edge 20
39 lateral flanks of 12
h axial height of the latching lug 12 without 38
H axial height of the latching lug 12 with 38
L running direction
S pole longitudinal axis
U circumferential direction
11 length of 3 in the rear region
12 length of 3 in the front region
b3 width of 11
b3' width of 11'
d1 diameter of 4 on 9
d2 diameter of 4 on 13
d3 largest diameter of 11
d3' largest diameter of 11'
E1 plane perpendicular to the pole longitudinal axis S, frequently plate plane, or parallel thereto
E2 plane formed by the exposed upper edge of the sleeve engaging around the pole tube 1

The invention claimed is:

1. An attachment for a pole,
said attachment having a substantially cylindrical sleeve which is fastenable to a lower free end of a pole tube and has an upwardly open blind hole for receiving the lower free end of the pole tube, the pole tube having a longitudinal axis,
wherein an interchangeable element is fastenable releasably to the sleeve in a form-fitting and force-fitting manner,
wherein the sleeve has a head region and a body region downwardly adjoining the head region,
wherein at least one axial portion of the body region of the sleeve has an external thread,
wherein the interchangeable element has a tip or a rolling surface at a lower end thereof, or a tip is embedded into the lower end thereof,
wherein the interchangeable element has an axial upwardly open blind hole for receiving the sleeve,
wherein the interchangeable element has an internal thread in its blind hole, said internal thread being suitable for engaging in the external thread arranged on the sleeve, for the purpose of fastening the interchangeable element to the sleeve, and
wherein the interchangeable element has at least one latching lug which extends in an axial direction and is suitable for engaging in a corresponding recess arranged on the sleeve.

2. The attachment as claimed in claim 1, wherein the interchangeable element has a plate region.

3. The attachment as claimed in claim 2,
wherein the interchangeable element has only one single latching lug extending in the axial direction and the sleeve has only one, corresponding, axial recess, and
wherein said single latching lug is arranged on a side of the interchangeable element which is directed counter to a moving direction and on which the plate region has a largest diameter, as measured in a direction opposed to the moving direction.

4. The attachment as claimed in claim 3, wherein the plate region has a reinforcing rib which extends in a direction opposed to a moving direction from the at least one latching lug to a radial tip of the plate region at a point of a largest diameter of the plate region.

5. The attachment as claimed in claim 2, wherein the plate region has a reinforcing rib.

6. The attachment as claimed in claim 2, wherein the interchangeable element has an asymmetric plate region.

7. The attachment as claimed in claim 6, wherein the plate region extends substantially in a plane perpendicular to the longitudinal axis of the pole tube.

8. The attachment as claimed in claim 6, wherein the plate region has a toothing at its lower end.

9. The attachment as claimed in claim 2, wherein the interchangeable element is detachable from the sleeve by removal of the latching lug from the recess, by means of deformation of the plate region, by means of pressing the plate region down in the direction of the pole tube longitudinal axis, and by subsequent unscrewing of the interchangeable element from the sleeve.

10. The attachment as claimed in claim 1, wherein the interchangeable element is detachable from the sleeve by removal of the at least one latching lug from the recess.

11. The attachment as claimed in claim 1, wherein the interchangeable element is removable from the sleeve by removal of the at least one latching lug from the recess and by subsequent unscrewing of the interchangeable element, wherein, either in a state latched into the recess, the at least one latching lug protrudes for this purpose over a surface contour of the sleeve at least in an upper region, or the recess axially above a free end of the at least one latching lug in the latched-in state leaves free a recess for engagement with a tool, or, in the interchangeable element comprises an element which facilitates movability of the at least one latching lug when a pole plate is pressed down, and/or the latching lug is integrally formed over a movable region in the form of a rocker on the interchangeable element; or an upper edge of the interchangeable element, said upper edge facing a head region of the sleeve, has, in the circumferential direction on one side or on both sides of the at least one latching lug, a depression which extends to the pole plate in an axial direction, and therefore the axial height and thus the free length of the at least one latching lug is extended; or the interchangeable element has a partially movable region with the at least one latching lug, which region forms the upper region of the interchangeable element and is displaceable in the radial direction relative to the lower region of the interchangeable element such that the at least one latching lug can be pushed out of the recess by manipulation of a pressing region opposite the at least one latching lug.

12. The pole as claimed in claim 11, wherein the element which facilitates the movability of the at least one latching lug when the pole plate is pressed down is a slot in a wall of the interchangeable element.

13. The attachment as claimed in claim 1, wherein the external thread on the body region of the sleeve is spaced apart axially from the head region, or wherein the head region is separated from the body region of the sleeve by an encircling first step.

14. The attachment as claimed in claim 1, wherein an upper edge of the sleeve runs at the upper end of the sleeve in a plane which is arranged inclined with respect to a plane running perpendicularly to the pole tube longitudinal axis, and therefore the sleeve has different lengths, as measured in the longitudinal direction parallel to the pole tube longitudinal axis, as measured from the upper edge of the sleeve as far as a lower edge of the sleeve at a lower end of the sleeve.

15. The attachment as claimed in claim 1, wherein the head region of the sleeve is of conical design, wherein the diameter of the head region widens downward toward the body region.

16. The attachment as claimed in claim 1, wherein a lower edge of the head region of the sleeve has a diameter corresponding to an upper edge of the interchangeable element at an upper end of the interchangeable element.

17. The attachment as claimed in claim 1, wherein an encircling first step between the head region and the body region of the sleeve forms an upper stop for an upper edge of the interchangeable element at the upper end of the interchangeable element.

18. A pole, having a pole tube with a pole handle at an upper free end, wherein the lower free end of the pole tube has an attachment as claimed in claim 1.

19. The pole as claimed in claim 18, wherein the sleeve is mounted fixedly at the lower free end of the pole tube.

20. The pole as claimed in claim 18, wherein the sleeve is mounted fixedly at the lower free end of the pole tube, by means of an integrally bonded, force-fitting or form-fitting connection, including by means of at least one of adhesive bonding and pressing on.

21. The attachment as claimed in claim 1, wherein the attachment is for at least one of a trekking pole, cross-country ski pole, Nordic walking pole, or alpine ski pole.

22. The attachment as claimed in claim 1, wherein the at least one latching lug is suitable for engaging in a corresponding, axial recess arranged on the sleeve, wherein the interchangeable element has only one single latching lug extending in the axial direction, and, the sleeve has only one corresponding, axial recess.

23. The attachment as claimed in claim 1, wherein the interchangeable element is removable from the sleeve by removal of the latching lug from the recess and by subsequent unscrewing of the interchangeable element, wherein, in the interchangeable element, an element which facilitates the movability of the latching lug when a pole plate is pressed down has in the form of a slot in a wall of the interchangeable element, or wherein the latching lug is integrally formed over a movable region in the form of a rocker on the interchangeable element, and a pressing region is arranged in a lower region facing the pole plate; or wherein an upper edge of the interchangeable element that faces a head region of the sleeve has, in the circumferential direction on one side or on both sides of the latching lug, a depression which extends to the pole plate in the axial direction, and therefore an axial height and thus a free length of the latching lug is extended, and wherein lateral flanks of the latching lug in the circumferential direction can be beveled.

24. The attachment as claimed in claim 1, wherein the external thread on the body region of the sleeve is spaced apart axially from the head region, and wherein the head region is separated from the body region of the sleeve by an encircling first step.

25. A pole, in the form of a trekking pole, cross-country ski pole, Nordic walking pole, or alpine ski pole, having a pole tube with a pole handle at an upper free end, wherein the lower free end of the pole tube has an attachment as claimed in claim 1.

* * * * *